US006894443B2

(12) United States Patent
Hunt et al.

(10) Patent No.: US 6,894,443 B2
(45) **Date of Patent: *May 17, 2005**

(54) STAGE LIGHTING LAMP UNIT AND STAGE LIGHTING SYSTEM INCLUDING SUCH UNIT

(75) Inventors: Mark A. Hunt, Derby (GB); Keith J. Owen, Birmingham (GB); Michael D. Hughes, Wolverhampton (GB)

(73) Assignee: Production Resource Group L.L.C., New Windsor, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/625,465

(22) Filed: Jul. 22, 2003

(65) Prior Publication Data

US 2004/0125602 A1 Jul. 1, 2004

Related U.S. Application Data

(63) Continuation of application No. 10/007,008, filed on Dec. 4, 2001, now Pat. No. 6,597,132, which is a continuation of application No. 09/313,418, filed on May 17, 1999, now Pat. No. 6,326,741, which is a continuation of application No. 08/994,036, filed on Dec. 18, 1997, now Pat. No. 5,921,659, which is a division of application No. 08/576,211, filed on Dec. 21, 1995, now Pat. No. 5,788,365, which is a continuation of application No. 08/077,877, filed on Jun. 18, 1993, now Pat. No. 5,502,627.

(30) Foreign Application Priority Data

| | | |
|---|---|---|
| Sep. 25, 1992 | (GB) | 9220303 |
| Sep. 25, 1992 | (GB) | 9220309 |
| Apr. 20, 1993 | (GB) | 9308071 |

(51) Int. Cl.[7] ..... H05B 37/00

(52) U.S. Cl. ..... 315/312; 315/316; 362/233

(58) Field of Search ..... 315/316, 312, 315/294, 292, 318, 319; 362/301, 233, 293

(56) References Cited

U.S. PATENT DOCUMENTS

| | | | | |
|---|---|---|---|---|
| 4,392,187 | A | 7/1983 | Bornhorst | 362/233 |
| 4,716,344 | A | 12/1987 | Newell et al. | 315/294 |
| 4,837,665 | A * | 6/1989 | Hoyer et al. | 362/96 |
| 4,980,806 | A | 12/1990 | Taylor et al. | 315/316 |

(Continued)

FOREIGN PATENT DOCUMENTS

| | | |
|---|---|---|
| EP | 0 495 305 | 7/1992 |
| FR | 2 643 134 | 8/1990 |
| GB | 2 209 229 | 5/1989 |
| GB | 2 231 138 | 11/1990 |
| WO | 89 054 21 | 6/1989 |

*Primary Examiner*—Tuyet Vo
*Assistant Examiner*—Ephrem Alemu
(74) *Attorney, Agent, or Firm*—Fish & Richardson P.C.

(57) ABSTRACT

A stage lighting lamp unit includes a processor for receiving control data from a remote console. Beam orientation data for the lamp unit is passed to the lamp in the form of the x, y and z co-ordinates of a point in space through which the beam is to pass. The processor divides the required lamp travel into a number of stages dependent on execution duration data sent with the position data, and calculates, for each stage, a new value for pan and tilt angles for the lamp. These values are passed to pan and tilt controlling co-processors which control servo-motors for pan and tilt operation. The lamp unit also incorporates a rotatable shutter for interrupting the lamp beam when required. The shutters of all the lamps in a system can be instructed from the remote console to open and close in synchronism, thereby providing a stroboscopic effect.

37 Claims, 10 Drawing Sheets

U.S. PATENT DOCUMENTS

| | | | | |
|---|---|---|---|---|
| 5,005,162 | A | 4/1991 | Mitsumori et al. | 369/112.29 |
| 5,010,459 | A | 4/1991 | Taylor et al. | 315/292 |
| 5,045,983 | A | 9/1991 | Shields | 367/293 |
| 5,414,328 | A | 5/1995 | Hunt et al. | 315/292 |
| 5,502,627 | A | 3/1996 | Hunt et al. | 362/286 |
| 5,588,021 | A | 12/1996 | Hunt et al. | 370/246 |
| 5,769,531 | A | 6/1998 | Hunt et al. | 362/233 |
| 5,788,365 | A | 8/1998 | Hunt et al. | 362/301 |
| 5,921,659 | A | 7/1999 | Hunt et al. | 362/233 |
| 6,326,741 | B1 | 12/2001 | Hunt et al. | 315/316 |

* cited by examiner

STAGE LIGHTING LAMP UNIT AND STAGE LIGHTING SYSTEM INCLUDING SUCH UNIT

This application is a continuation (and claims the benefit of priority under 35 USC 120) of U.S. application Ser. No. 10/007,008, filed Dec. 4, 2001 (now U.S. Pat. No. 6,597,132), which is a continuation of U.S. application Ser. No. 09/313,418, filed May 17, 1999 (now U.S. Pat. No. 6,326,741), which is a continuation of U.S. application Ser. No. 08/994,036, filed Dec. 18, 1997 (now U.S. Pat. No. 5,921,659), which is a divisional of U.S. application Ser. No. 08/576,211, filed Dec. 21, 1995 (now U.S. Pat. No. 5,788,365), which is a continuation of U.S. application Ser. No. 08/077,877, filed Jun. 18, 1993 (now U.S. Pat. No. 5,502,627).

This invention relates to stage lighting and is particularly concerned with the control of multiple functions of a lamp.

It has already been proposed to incorporate in a lamp unit a plurality of different functions, such as colour changers, focusing lenses, iris diaphragms, gobo selectors and pan and tilt mechanisms which are controlled from a remote console. Stage lighting systems have as a result reached very high levels of complexity requiring a very complicated main control console and lamp unit constructions. The use of microprocessors, both in the console and the lamps has become conventional as increasing complexity makes it more difficult to produce and subsequently maintain a system which uses hard wired, logic or analog controls. In such systems the microprocessor in the console is used to allow the user to set up lighting cues and to control the sending of appropriate data to the lamp microprocessors. The lamp microprocessors are also involved in controlling communication between the console and the lamps, and also have to control a plurality of servo-motors which drive the various functions of the lamps.

It is one object of the present invention to provide a lamp microprocessor and servo-control arrangement which allows complex functions to be carried out.

It is another object of the invention to provide a lamp control system in which control of pan and tilt movements of each lamp can be carried out in rapid and efficient manner, enabling large groups of lamps to make co-ordinated movements.

It is yet another object of the invention to provide each lamp in a stage lighting system with a means for quickly interrupting its light beam and quickly re-establishing the beam so that a group of lamps can be made, when required to flash in synchronism.

In accordance with one aspect of the invention there is provided a lamp unit for connection to a remote control console for the control of a plurality of different functions of the lamp, said unit comprising a main processor circuit, associated with a communication controller for accepting message data from the console, a plurality of servo-controls for operating said functions of the lamp, and a plurality of co-processors which are-connected to the main processor circuit so as to be supplied thereby with desired value data for the various lamp functions, said servo-controls being controlled by said co-processors.

In the case of pan and tilt controls where close control is required throughout the movement of the lamp from an initial position to a new position, one of the co-processors is assigned solely to the control of movement about each axis. Other functions can share a co-processor.

The main processor circuit of the lamp is preferably programmed to accept data from the control console defining not only a target position for any function, but also a duration over which the function is to be executed. In this case the main processor circuit divides the "journey" into segments and updates the target position data passed to the associated co-processor at intervals.

In accordance with another aspect of the invention, there is provided a lighting control apparatus comprising the combination of a main control console for accepting user input relating to required beam movements, a plurality of independently operable lamp units situated remotely from the console, each of the lamp units incorporating a servo-mechanism for automatically moving the lamp beam about two mutually transverse axes to a desired angular position and data communication means connecting the console to the lamp units for the transmission of desired position data to the lamp units, the desired position data being transmitted in the form of a set of three dimensional linear co-ordinates defining a point in space through which the lamp beam is required to pass, and each lamp unit including a calculating device for calculating the desired angular position from the desired position data and supplying the servo-mechanism with such desired angular position.

In addition to the "point at" mode of operation mentioned above, additional modes may be specified in which the lamps point away from the specified point or in which they all point in the same direction parallel to a line between a fixed position in the co-ordinate system and the specified point.

Conveniently, all the data concerning the positions and orientations of the individual lamp units within the co-ordinate system is stored in a set-up file kept on a hard disk drive in the console. When the same lighting set-up is used at different venues, where it is impossible to set the frame which carries all the lamp units at exactly the same position as that for which the set-up was designed, offset data can be input at the console and either used within the console microcomputer to correct the position data stored during set-up as it is sent out, or such data can be sent to all or the lamp units over the network and stored there, to enable the corrections to be made in the individual lamp processor units.

In accordance with another aspect of the invention, a stage lighting unit comprises a housing, a light source within said housing, an optical system for forming light from said light source into a beam, a rotary shutter device having a plurality of blades, said shutter device being rotatably mounted in the housing so as to cause said blades to pass through and obstruct said beam as the shutter device rotates, a motor for rotating said shutter device and a servo-control for controlling said motor in accordance with data received in use from a remote control console.

The invention also resides in a stage lighting system incorporating a plurality of lighting units as defined above controlled by a common remote control console via data communication means, whereby the rotary shutter devices of all the units can operate in synchronism.

An example of the invention will now be described with reference to the accompanying drawings, in which:

FIGS. 4 to 7 are detailed circuit diagrams showing a rotary shutter motor drive control forming part of the internal circuitry of the lamp;

Figure 1:
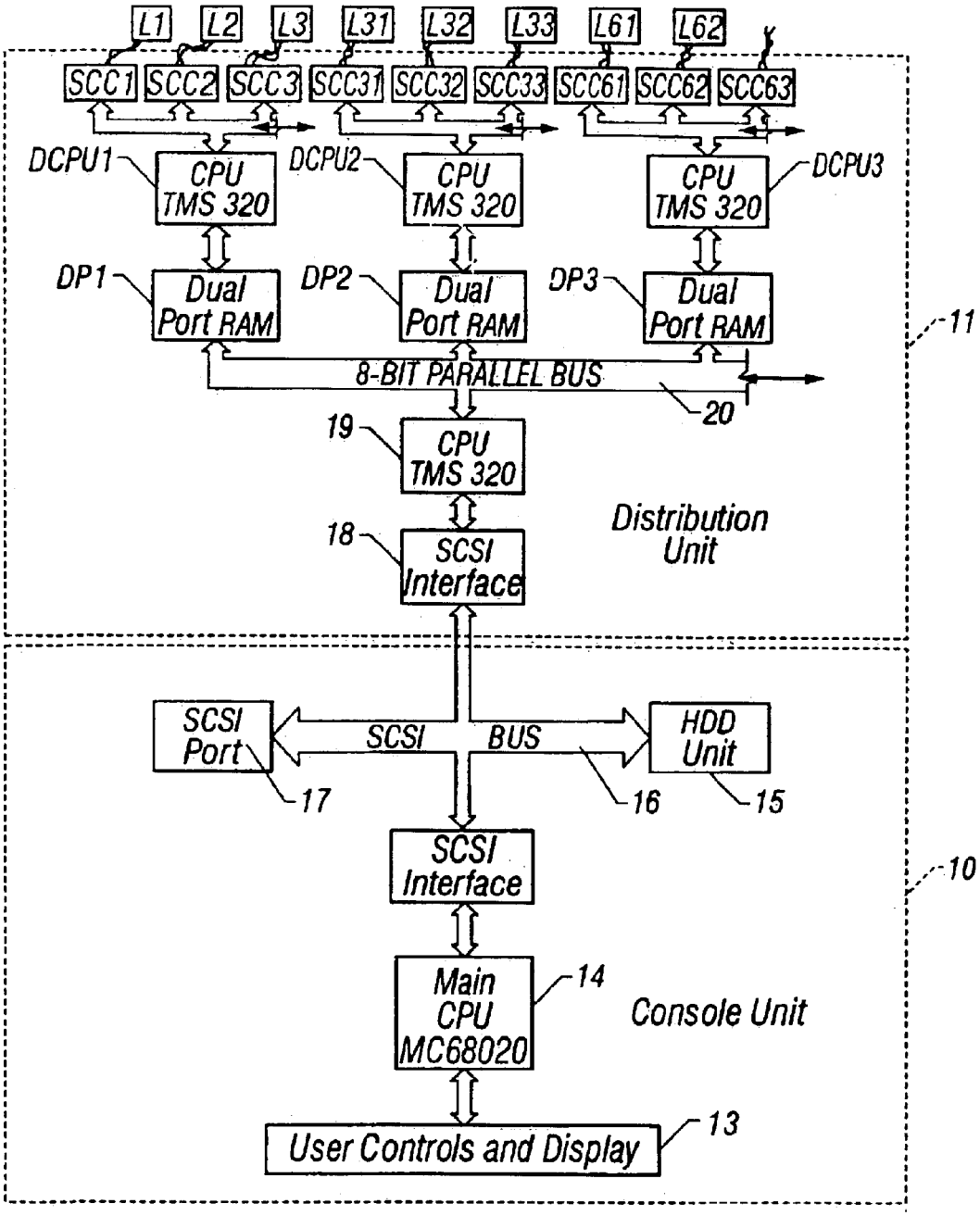
FIG. 1 is a block diagram of a stage lighting system.

Referring firstly to FIG. 1, the system consists basically of a console unit 10; a signal distribution unit 11 and a plurality of lamps L1, L2, L3 . . . , L31, L32, L33 . . . , L61, L62 . . . individually connected by twisted pair data communication links to the distribution unit.

The console unit 10 has an array of switches, slider potentiometers, rotary digital encoders and other user actuable input devices (not shown) and a display indicated at 13. These are all connected to main console cpu 14 (an MC68020 micro-processor) which has the task of receiving inputs from the user actuable input devices and controlling the display. Both tasks are assisted by separate co-processors which directly interface with different parts of the console.

The main cpu can communicate with a hard disk drive unit 15 via a SCSI bus 16 which also connects it to the distribution unit and to an external SCSI port 17, through the intermediary of which the console can, if required be connected to a personal computer. The user controls can be used in setting up a sequence of cues in advance of a performance, the sequence being stored in a cue file on the hard disk drive unit 15. The sequence can be recalled during the performance to enable the various stored cues to be executed. Direct manual control of the lamps from the console is also possible as is manual editing of cues called up from the hard disk. The main console cpu 14 creates messages to be sent to the individual lamps, each message comprising a fixed number of bytes for each lamp. The messages contain data relating to the required lamp orientation, beam coloration, iris diaphragm diameter, gobo selection and rotation, zoom projection lens control and opening or closing of a shutter included in the lamp. A block of the RAM of the main cpu is set aside for the storage of these messages, the block being large enough to contain messages for 240 lamps, being the largest number which can be controlled via the distribution unit. Where it is required to control more than 240 lamps additional distribution units can be connected to the SCSI bus and extra main cpu RAM reserved for message storage. When any message data is changed the main cpu 14 sets a flag in the RAM block which is detected at a given point in the main cpu program loop and interpreted as a signal that the changed message data is to be transferred to the distribution unit 11.

The distribution unit 11 has a main cpu 19 which controls reception of data from the SCSI bus interface and distribution of such data to up to eight blocks of dual,port memory DP1, DP2, DP3 . . . via an eight bit data bus 20. The cpu 19 is alerted to the waiting message data when cpu 14 selects the distribution unit. The cpu 19 then supervises byte by byte transfer of the message data which it routes to the various blocks of dual port memory.

For actually sending out the message data to the lamps, there are a plurality of serial communication controllers SCC1 to SCC30, SCC31 to SCC60 etc, there being thirty serial communication controllers associated with each block of dual port memory. A further cpu DCPU1, DCPU2, etc is associated with each block of dual port memory and distributes message data transferred to the dual port memory to the individual serial communication controllers and the messages are transferred to the lamps. Each serial communication controller in the distribution unit includes a line driver which can be disabled except when data is to be transmitted. Enabling of the driver can cause a spurious signal to be transmitted over the data link. To allow such spurious signals to be identified and ignored, a two-byte gap is left between enabling the line driver and commencing transmission of the message data for the channel in question.

This will be described in more detail herein. All asynchronous serial communication systems require framing information to synchronize the reception process. This has been typically done in the prior art using start bits and stop bits.

The present invention preferably uses FM0 coding in which the data is transmitted as one cycle of the carrier frequency for a zero or as a half cycle of the carrier frequency for a one. When the line has been idle, no waveform at all is present. When the line drivers are first enabled, an arbitrarily short pulse will usually appear on the line, due to lack of synchronization between the data signal and the enabling signal. This short data pulse could be misinterpreted as a start bit, for example and if so it would disturb later framing.

The present invention avoids any problems from this arbitrarily short pulse. To avoid this, the present invention uses a timer on the receive line, set to the time needed to receive two bytes on the serial data line. This timer is restarted whenever a byte on the data line is detected.

Each time the timer interrupt occurs, the number of bytes received is checked against the number of bytes in a valid data frame. If the number is incorrect, then the count is cleared and the message is discarded. If correct, the information is passed to the main program loop by setting a flag variable.

When the data line is first enabled, the distribution box has an internal delay of at least two byte times, which must elapse before any data will be sent. Any data received by the lamp will therefore be discarded as noise by the timer interrupt routine. After that, the real data can be safely sent down the line since the start bit of the first byte will be received correctly. When the transmission is completed, the line drivers will be disabled again.

Each of the cpus eg DCPU1, transfers data from the associated dual port RAM DP1 to the serial communication controller SCC1 to SCC30 with which it is associated one byte at a time, ie the first byte for SCC1 is transferred followed by the first byte for SCC2 and so on, each serial communication controller commencing transmission as soon as it has received its byte of data. The serial communication controllers operate to transmit data at 230.4 Kbps so that it takes about 35 $\mu$s to transmit each byte. Transfer of data from the dual port RAM DP1 to the serial communication controllers is, however, at a rate of several Mbps, so that the transmissions from all the serial communication controllers are almost simultaneous. The cpu DCPU1 is not required to monitor the transmission of data by the serial communication controller, but utilizes a software timer to commence transfer of the second byte to the serial communication controllers. This timer is started when transfer of the byte of data to the last serial communication controller SCC30 has been completed and its time-out duration is slightly longer than the byte transmission time, say 40 $\mu$s. Transmission of all the messages takes about 1.5 ms out of a distribution unit main program loop duration of 4 ms.

Figure 2:
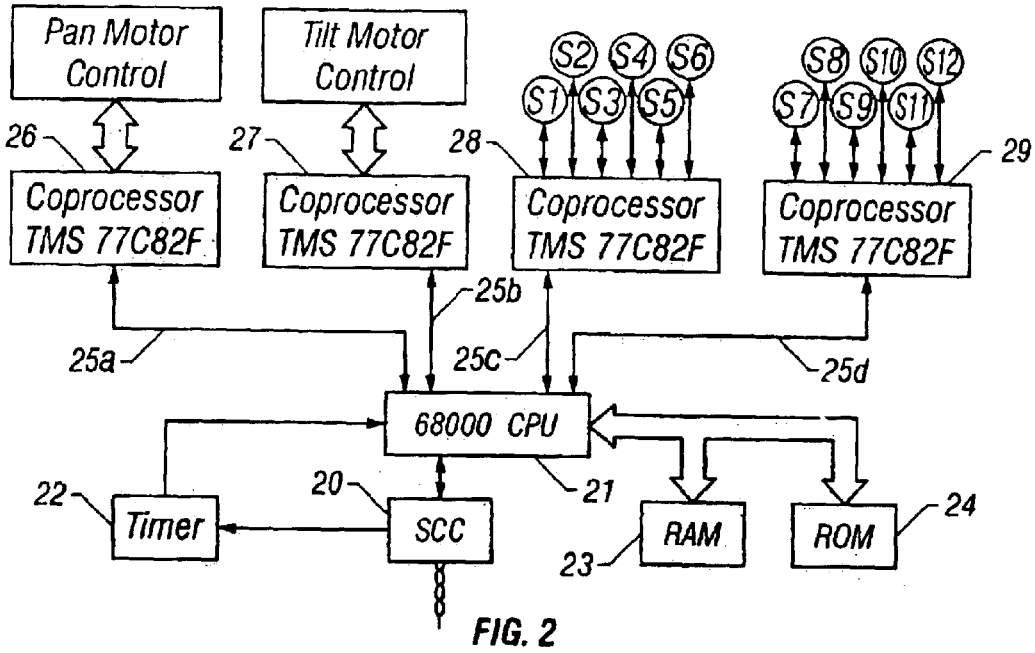
FIG. 2 is a block diagram of the internal circuitry of one of a plurality of lamp units in the system of FIG. 1.

As shown in FIG. 2, each lamp includes a serial communication controller 20 which controls reception of message data from the individual data link connecting it to the distribution unit 11. The receipt of any signal from the data link causes an interrupt of the lamp main cpu 21 (another MC68000) and the cpu 21 then controls acceptance of the signals. A timer 22 times the gaps between bytes received from the data link and this timer causes another interrupt on time-out. The time-out time of the timer is between the times taken to transmit 1 and 2 bytes, so that time out always occurs following a spurious signal caused by line driver enabling. The time-out interrupt causes the cpu 21 to inspect the total number of bytes received since the initial interrupt and if this is less than the expected number of bytes (which is constant) the message is ignored. The time-out interrupt also resets a software data pointer to the beginning of a receive buffer in readiness for the next transmission.

The cpu 21 operates in accordance with programs stored in the lamp cpu ROM. On receipt of a message of valid length, a program variable representing the number of messages received since the lamp program was last started is incremented and the main program loop of the lamp cpu checks this variable every 6 mS. If the variable has changed since the last check, the data in the receive buffer is compared with corresponding values of variables representing current "desired values" of the various lamp function parameters. For example the receive buffer may contain two bytes representing the x, y and z co-ordinates of a point in an orthogonal three dimensional frame of reference, through which point it is required that the axis of the lamp beam should be directed. If the values of the corresponding byte pairs in the receive buffer and the desired value variables already contained in the cpu RAM are the same, no action is taken in respect of the control of the motors which control pan and tilt action of the lamp (to be described in more detail hereinafter).

As shown in FIG. 2, the main lamp cpu 21 communicates via serial data links 25*a*, 25*b*, 25*c* and 25*d* with four servo-control co-processors 26, 27, 28 and 29. Each of these co-processors is a TMS77C82 cpu. Co-processors 26 and 27 respectively control pan and tilt operation, and each of the co-processors 28 and 29 can control up to six different dc servo-motors operating different functions of the lamp.

Figure 8:
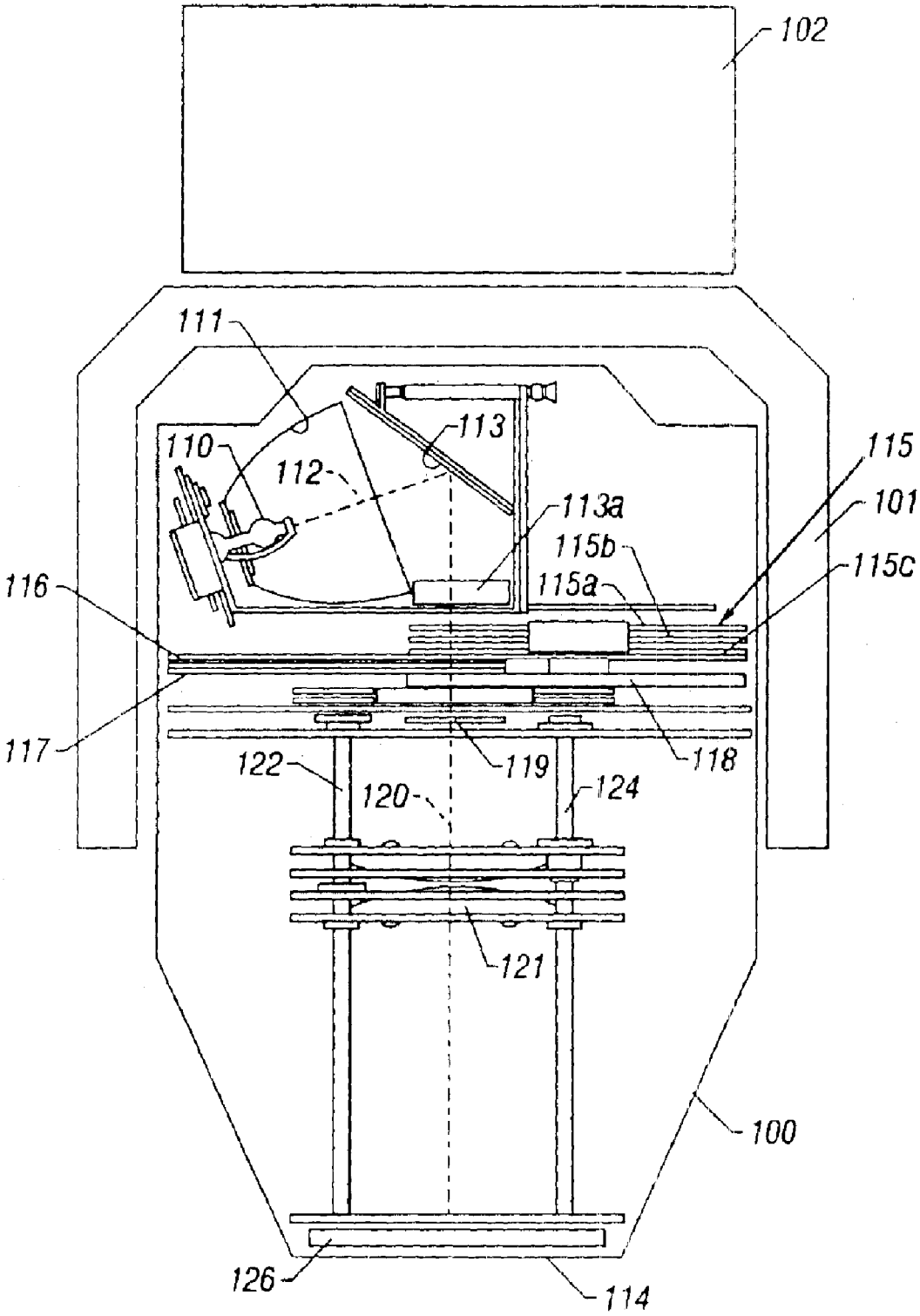
FIG. 8 is a diagrammatic, part-sectional view of one of the lamps.
Figure 9:
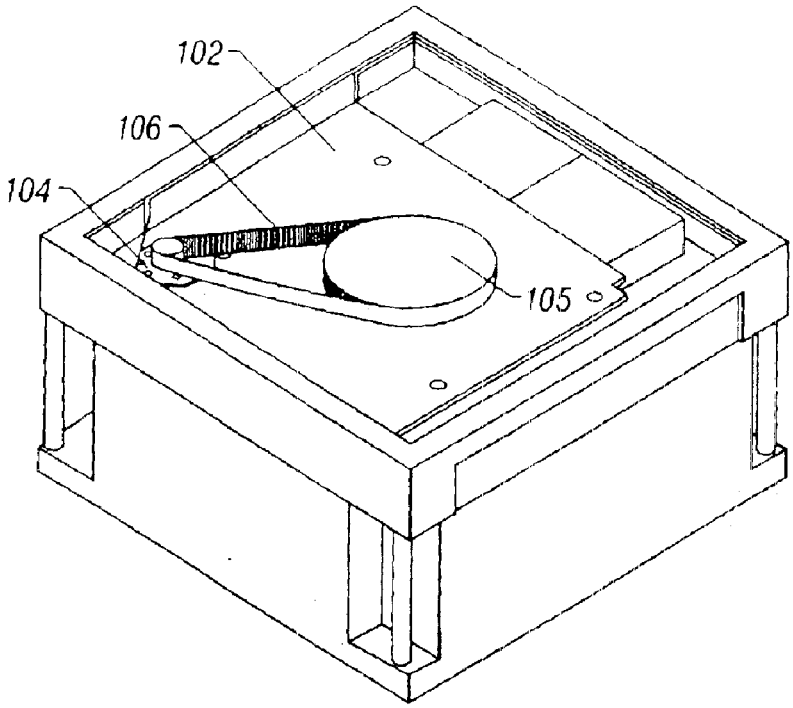
FIG. 9 is a perspective view of a pan movement drive arrangement.
Figure 10:
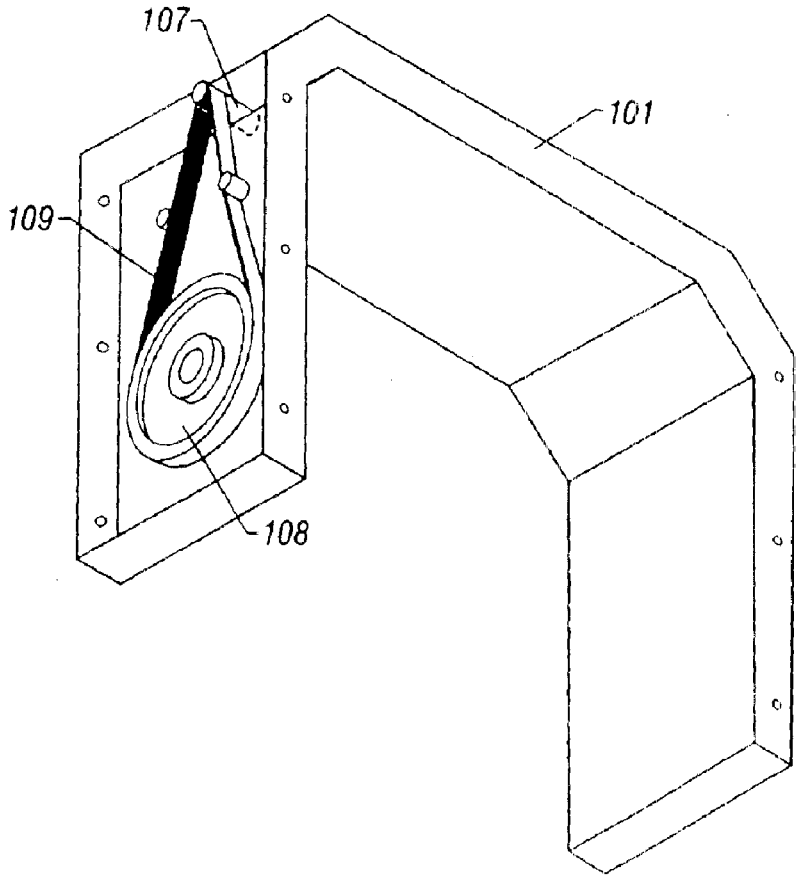
FIG. 10 is a perspective view of a tilt movement drive arrangement.

Before proceeding with a more detailed description of the circuitry and operation of the lamp electronics, some detail will be given of the various functions of the lamp. FIG. 8 shows the relative positions of a plurality of independently operable beam characteristic control elements within the lamp housing 100. The lamp housing is pivotally mounted on a U-bracket 101, which is itself pivotally mounted on a mounting base 102. FIG. 9 shows the mounting base 102 which incorporates a pan drive motor/gearbox/optical encoder arrangement 104 which drives a gear 105 attached to the U-bracket via a reduction toothed belt drive 106. FIG. 10 shows how, within the hollow structure of the U-bracket 101, there is mounted a tilt drive motor/gearbox/optical encoder 107 which drives a gear 108 attached to the lamp housing via another reduction toothed belt drive 109.

Figure 11:
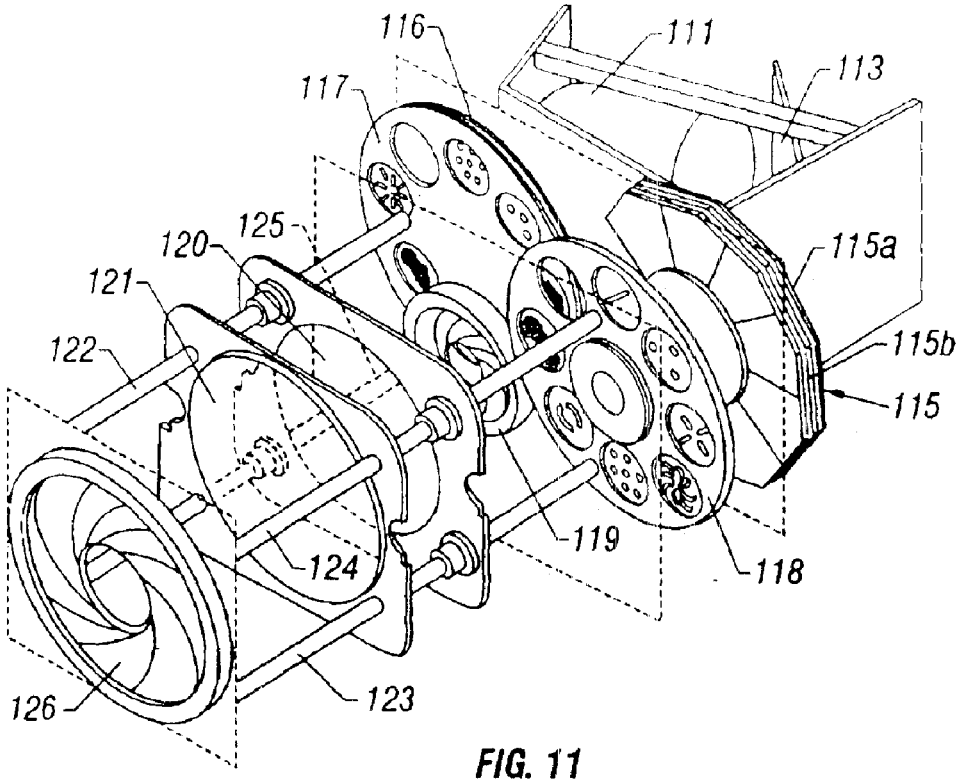
FIG. 11 is a diagrammatic perspective view of the internal moving parts of the lamp.
Figure 13:
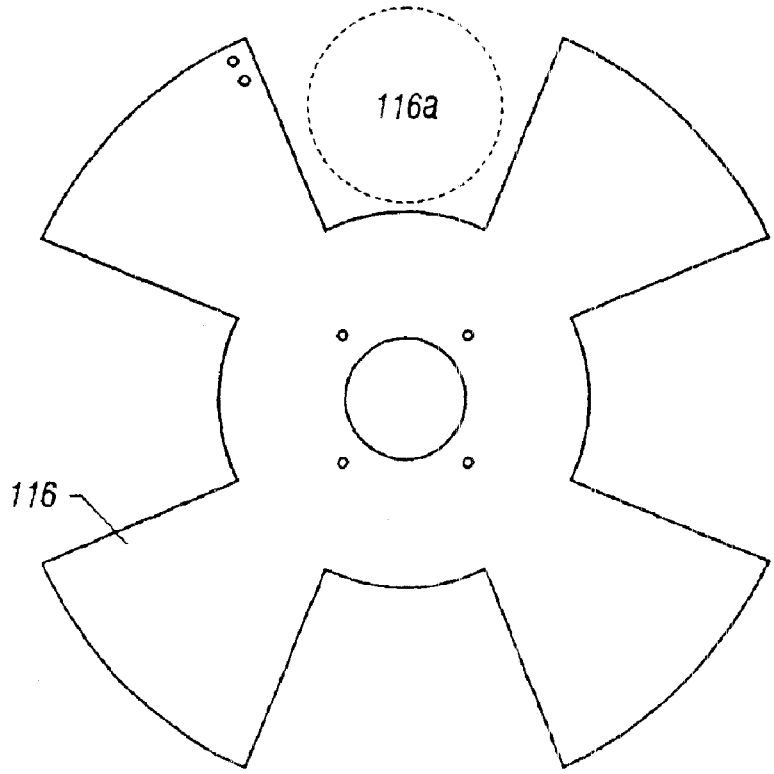
FIG. 13 is an elevation of a shutter wheel forming part of the lamp.
Figure 12:
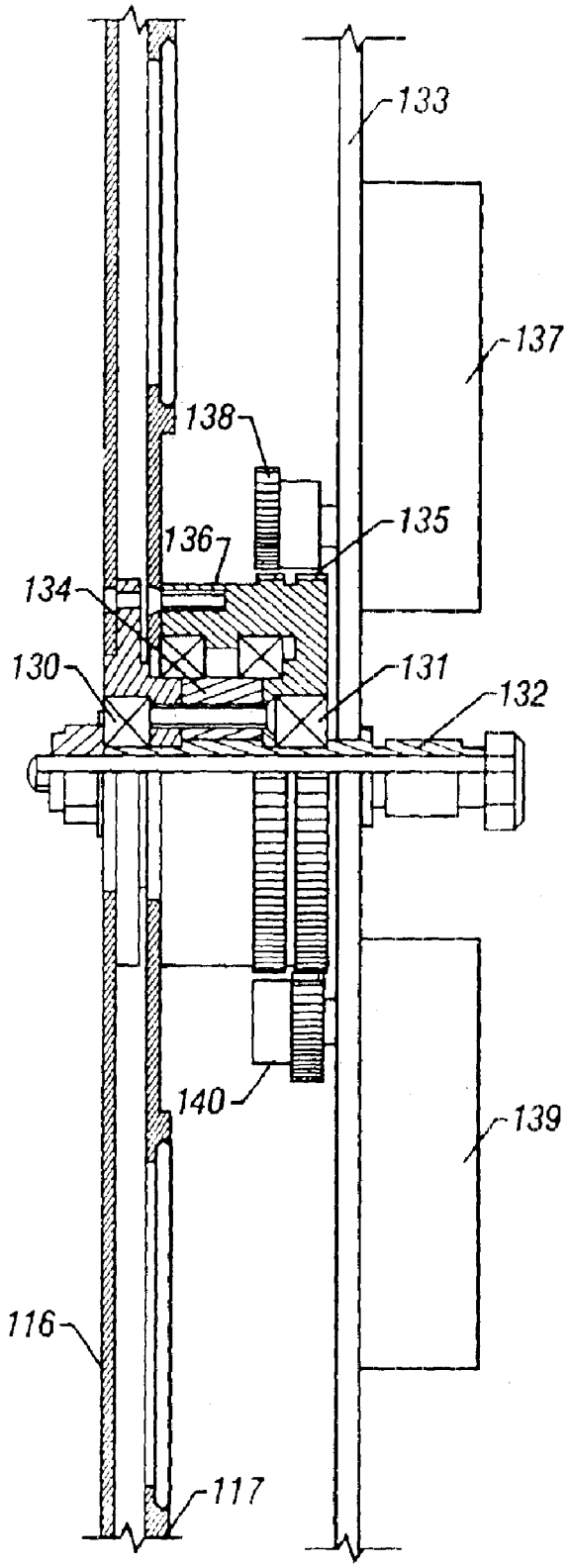
FIG. 12 is a sectional view showing the drive arrangement for a shutter and a gobo wheel forming part of the lamp.

As shown in FIGS. 8 and 11, within the lamp housing, a light source 110 is mounted within an ellipsoidal reflector 111 providing a light beam with an axis 112 which is reflected by a mirror 113, which is a dichroic mirror that reflects only visible light and passes ultra voilet and intra red light, the reflected light passing out through an opening 114 at the opposite end of the housing. The reflector 111 has a generally cup-shape surrounding the bulb 110. According to one aspect of the invention, the axis 112 has an angle pointing in a direction rearward relative to a perpendicular to the central axis 120 of the lamp unit. If the reflector is located as shown, such that an outside edge of the reflector is generally parallel to a rear end of the housing, the optimal packing efficiency is achieved. As shown in FIG. 8, this allows the reflector to be most efficiently packed into the available space. The reflected beam from the mirror 113 passes firstly through a collimating lens 113*a*, and then the colour changer 115 which comprises dichroic filters having differing transmission characteristics mounted on co-centered three filter disks 115*a*, 115*b* and 115*c* rotable around a common axis of rotation. Each disk has nine different filters on it and one blank space around its periphery, so that up to 1000 different combinations of filters can be positioned across the beam by selective positioning of the three disks (although not all of these combinations are necessarily useful as some may block all visible light). The blank space of each of the disks can be used to eliminate any color changing characteristic of that disk. These disks are driven by three of the dc servo-motors. Next the light beam passes through the plane of a bladed shutter 116 (shown in FIG. 13) and a first gobo wheel 117 which has various gobos mounted in or over circular holes therein. As shown in FIG. 12 described in more detail hereinafter, two motors are committed to driving the shutter 116 and the gobo wheel 117 respectively. Next, there is a second gobo wheel 118 on which there are mounted a plurality of gobos which are rotatable relative to the wheel 118. There is one motor (not shown) for driving the gobo wheel 118 and another for rotating the gobos mounted thereon through a gear arrangement (not shown). Next along the light beam is a beam size controlling iris diaphragm 119 driven by another motor (not shown). Two further motors (not shown) drive two lens elements 120, 121 along guides 122, 123 parallel to the beam axis using lead screws 124, 125. The lens elements form a simple two element zoom lens controlling the spread and focus of the beam. Finally, an outer iris diaphragm 126 is provided adjacent the opening 114 and this is driven by a further motor (not shown). In the example described, therefore only eleven channels are actually employed.

Referring now to FIG. 12, the shutter 116 is rotatably mounted on bearings 130, 131 on a shaft 132 fixed to a mounting panel 133 which is secured to the housing. The gobo wheel 117 is rotatably mounted on bearings on a tubular shaft 134 which acts to space the shutter 116 from a first drive gear 135. The gobo wheel 117 is actually mounted on a second drive gear 136. The shutter motor 137 (which is combined with a reduction gearbox and an optical encoder) is mounted on the panel 133 and drives a pinion 138 meshed with the first gear 136. Similarly motor 139 drives a pinion 140 meshed with the second gear 136. The shutter has four blades arranged symmetrically around its axis, with the blades and the gaps between them each subtending 45 degrees at the axis. The blades and the gaps between them are wide enough to block or clear the entire cross-section of the beam, shown in FIG. 13 at 116*a*.

Figure 3:
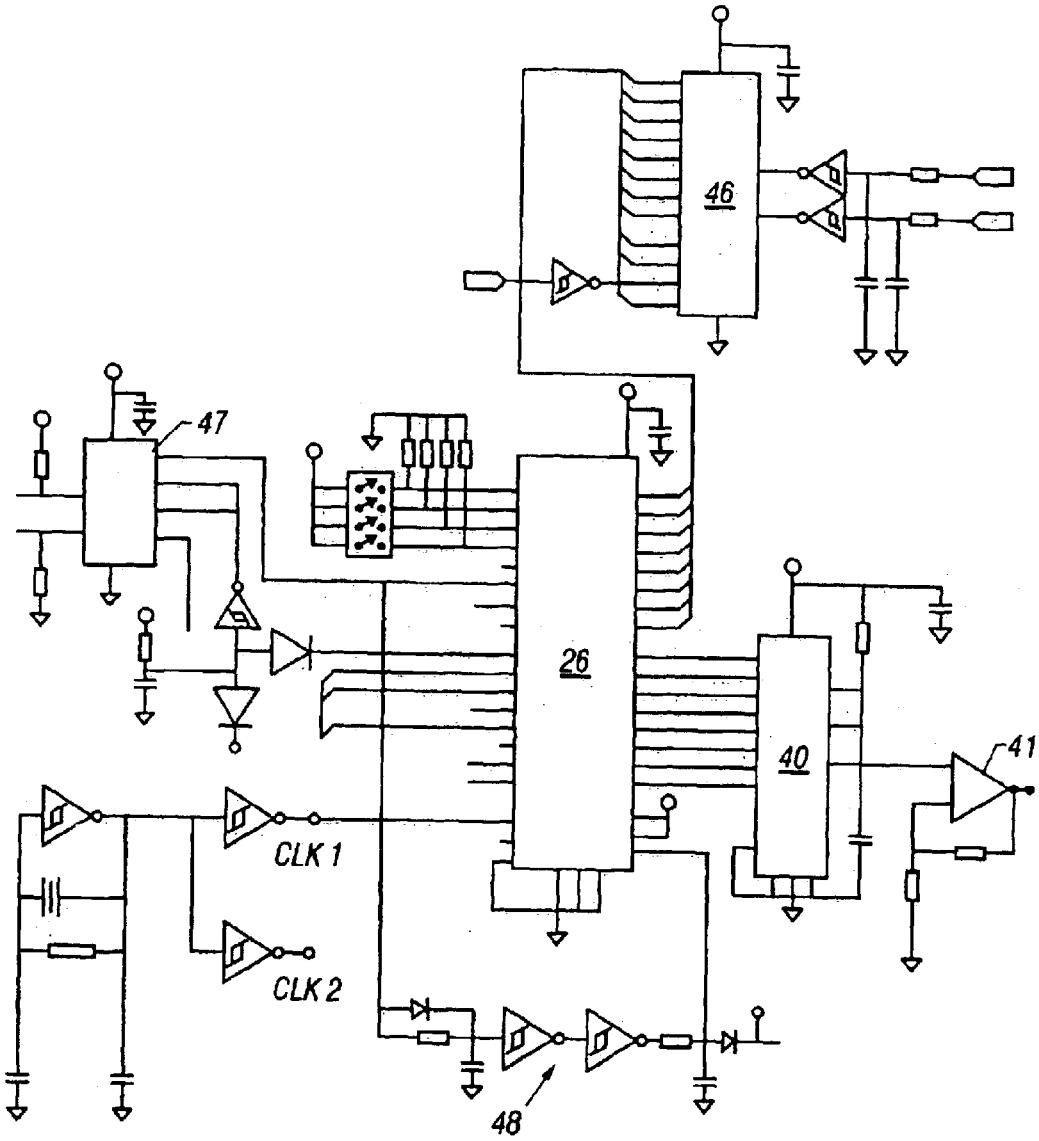
FIGS. 3 and 4 are more detailed circuit diagrams showing a pan motor drive control forming part of the internal circuitry of the lamp.
Figure 4:
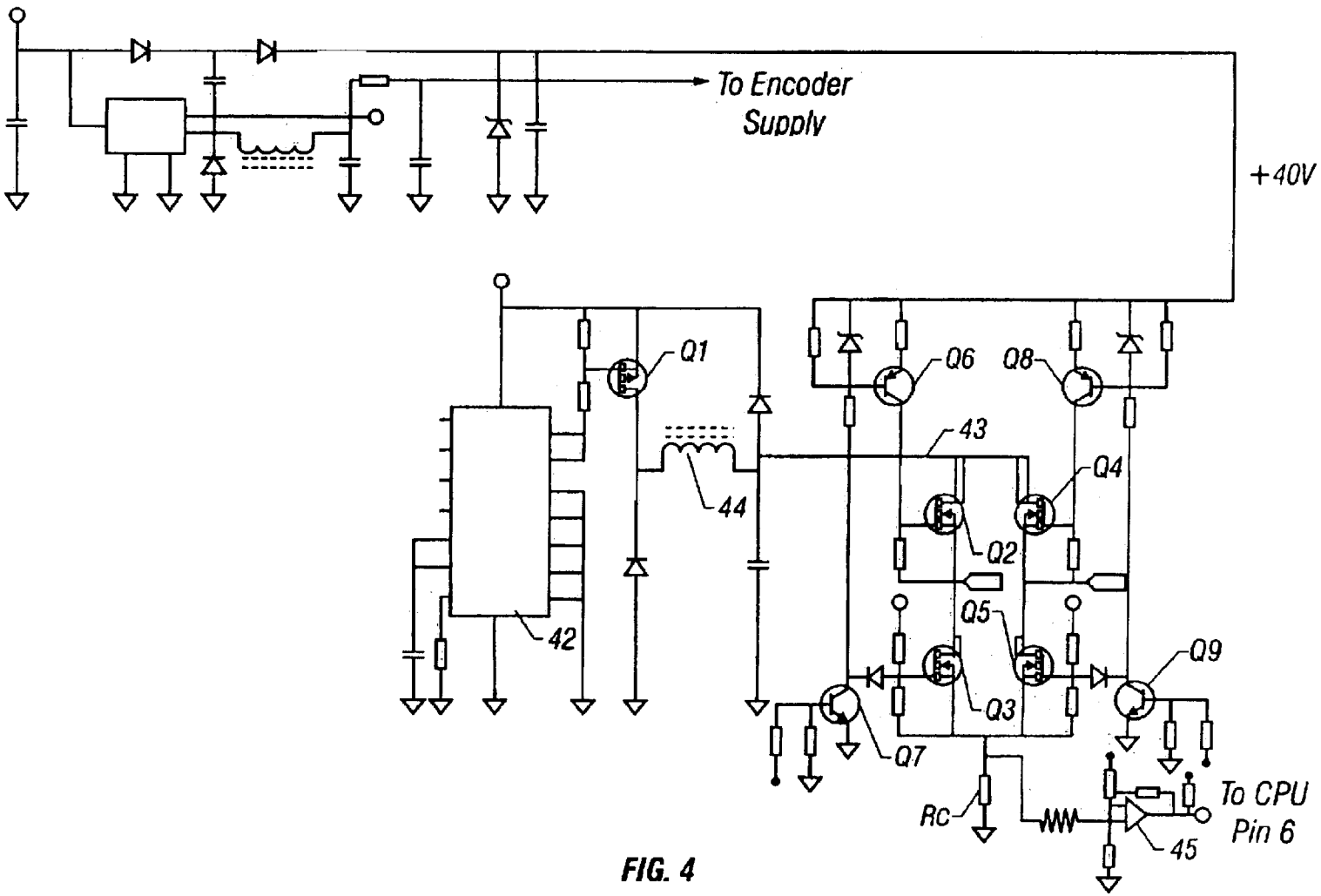

Turning now to FIGS. 3 and 4, the co-processor 26 is shown providing an eight bit data output to a d/a converter 40 (FIG. 3) the output of which is amplified by an operational amplifier 41 and supplied to the "COMPEN" terminal of an LM3524 pulse width modulator ic 42 (FIG. 4). The ic 42 control a P-channel enhancement mode MOSFET Q1 which, when switched on, connects a 24V supply to a motor supply bus 43 through the intermediary of an inductor 44. The motor is connected in a bridge formed by two push-pull pairs of MOSFETs Q2, Q3 and Q4, Q5. These four MOSFETs are driven by respective driver transistors Q6, Q7, Q8 and Q9. Transistors Q7 and Q9 are respectively controlled by "LEFT" and "RIGHT" outputs taken from the co-processor 26, so that FETs Q2 and Q5 or FETs Q3 and Q4 are biassed to conduct. Transistors Q6 and Q8 are driven from a 40V supply rail so as to ensure that FETs Q2 and Q4 are turned hard on when conductive, thereby ensuring minimum power dissipation in these devices.

The two FETs Q3 and Q4 are connected to the return bus via a current sensing resister RC, which supplies a current related signal to a voltage comparator 45 with hysteresis to provide an input to the A6 input terminal of the co-processor 26 when the current exceeds a predetermined limit. This enables the co-processor to reduce the power applied to the motor to maintain it within safe operating limits.

The optical encoder of the pan motor provides two digital outputs in quadrature, these outputs being cleaned up by interface circuits and applied to two inputs of an HCTL-2016 counter ic 46 intended specifically for use with quadrature type encoders. The counter 46 counts up when the pulses are in one relative phase relationship and down when the opposite phase relationship exists. It therefore maintains a count-state related to the motor shaft position and hence the pan angle of the lamp. This count-state is applied to the C0 to C7 terminals of the co-processor 26. The co-processor 26 also receives "desired value" data from the main lamp cpu 21, via a 75176 ic 47 (which in fact serves both co-processors 26 and 27). The ic 47 is used to control the transmission of data between the main lamp cpu and the co-processors. Normally the ic 47 is set to receive data from the cpu 21 and pass it to the two co-processors 26 and 27. At power-up or when the main lamp cpu 21 transmits a "break" command, the co-processor 26 is reset by a circuit 48. The co-processor 26 has a cycle time of 1 mS and on receipt of new data it determines the distance to be travelled and then increases the "desired position" value which is compared with the actual position count by one sixteenth of the required change on each successive iteration of its control loop.

The desired value signals passed from the cpu 21 to the co-processor 26 are also time-sliced, being incremented every 16 mS. When new position data is transmitted to the lamp it is accompanied by data representing the length of time over which the movement is to be spread. The data is received, as mentioned above, in the form of two byte numbers respectively representing the x, y and z co-ordinates of a point in a Cartesian co-ordinate system. During initial setting up of the system, each lamp is sent data which informs its cpu 21 of its position in the co-ordinate system and also of its orientation.

On receipt of a new set of "point at" co-ordinates, the cpu 21 undertakes a "time-slicing" operation to determine how data should be passed to the co-processors 26 and 27. First of all, it determines how many 16 mS loops will take place in the time duration determined by the data contained in the massage received by the lamp and sets up a variable U equal to the reciprocal of this number. A travel variable P is initialised to zero and the total distance to be travelled is determined for each of the pan and tilt movements. Thereafter, on every iteration of the 16 mS loop the travel variable P is incremented by the reciprocal variable U, the result is multiplied by the total travel required and this is added to (or subtracted from) the previous desired value before transmission to the co-processor 26 or 27. When the variable P exceeds unity, the target has been reached.

The message sent to the lamp may include a flag indicating whether travel is to occur in a linear fashion as described above or have a sinusoidal profile imposed on it. In the latter case the value of P is modified as follows:

$$P'=\sin(2*P)+0.5*(P>0.5) \text{ the latter term being 0 or 1}$$

The main cpu 26 must next convert the x,y,z values into pan and tilt value data for passing to the co-processors 26 and 27. The cpu first carries out a linear transformation of the absolute x,y,z co-ordinates into co-ordinates x',y',z' relative to the lamp's own frame of reference using the data supplied during initial set up. The ratio of the transformed x' and y' values is calculated as a 16-bit integer, which is used as an index to an ARCTAN table stored in ROM to obtain a value for the desired pan angle. To find the tilt angle, it is first necessary to establish the radial position of the target point in the transformed horizontal plane by calculating the square root of the sum of the squares of the co-ordinates x' and y'. In carrying out this calculation it is necessary to detect an overflow condition which exists if the sum of the squares is a 33 bit number. If this condition is detected, each square is divided by four and a new sum is formed, an overflow flag being set to indicate that overflow has occurred. The square root is found by up to sixteen steps of successive approximation and the result is doubled if the overflow flag was set during the calculation. The resulting square root is divided by the value z' and the result is applied as before to the ARCTAN table to determine the tilt angle. The results obtained represent the new pan and tilt positions to which the lamp is to be moved.

The arrangement described for sending out x, y and z co-ordinate data instead of pan and tilt angle data is highly advantageous in that it enables the console main cpu load to be significantly reduced and also makes it very easy for a console operator to control light beam movements. It is frequently required for a group of lamps to be used together to illuminate a single performer. Where the performer moves from one position on stage to another it is required for all the lamps to change position simultaneously to follow. If the system involved transmission of pan and tilt angle data, this data would be different for every lamp in the group. It would have to be set up by the console operator and stored in cue files on the hard disk drive unit 15. This would be a very time consuming operation as the pan and tilt angles for each lamp would have to be established and recorded individually. The cue record would need to be of considerable size to record all the different data for each lamp. With the arrangement described above, however, only the x,y,z co-ordinate data needs to be stored and when the cue is recalled the same data is sent to each of the lamps in the group.

Whilst it is theoretically possible to use stored cue data in x,y,z co-ordinate form and to use the console main cpu 14 to calculate the pan and tilt angles to send to the lamps, this would be unsatisfactory as the calculations involved would impose a very heavy load on the cpu 14, particularly where a large number of lamps in several different groups had to be moved as the result of a single cue.

As described above a "point-at" mode is envisaged as the normal operating mode. However, other modes of operation are also envisaged. For example, the lamp could be instructed to point away from the point specified or to point in a direction parallel to a line joining a fixed point (eg the origin of the co-ordinate system) to the point specified. These "point-away" and "point parallel" modes would be selected by means of flags included in the data transmitted to the lamps.

The arrangement described enables the lamps to be very precisely synchronised. The data is transmitted from the distribution unit to all of the lamps simultaneously and each lamp can start to respond at the end of the message. This enables very precise direction of all the lamps to a moving point in "point-at" mode and very clean parallel sweeps to be made in "point parallel" mode.

It should be noted that the use of x,y,z co-ordinates is also very advantageous in situations where a pre-arranged lighting performance is to be used in several different venues. The pre-loaded gantries or trusses used for such touring performances cannot always be mounted at exactly the required positions relative to the stage because of local conditions. In this case all that is needed is for offsets data to be sent to the lamps at set-up time to enable each lamp cpu to correct its position data. No editing of the individual pre-recorded cues is necessary as it would be in the same circumstances if pan and tilt data were stored.

As part of the set-up procedure for each performance it is necessary to initialise the values of the actual pan and tilt angle count-states, since encoders of the type used do not give any absolute position data. This is accomplished by driving the lamp to an end stop in one direction for each movement. The lamp is driven back to a predetermined number of counts and the counters are reset to zero at this position.

Figure 7:
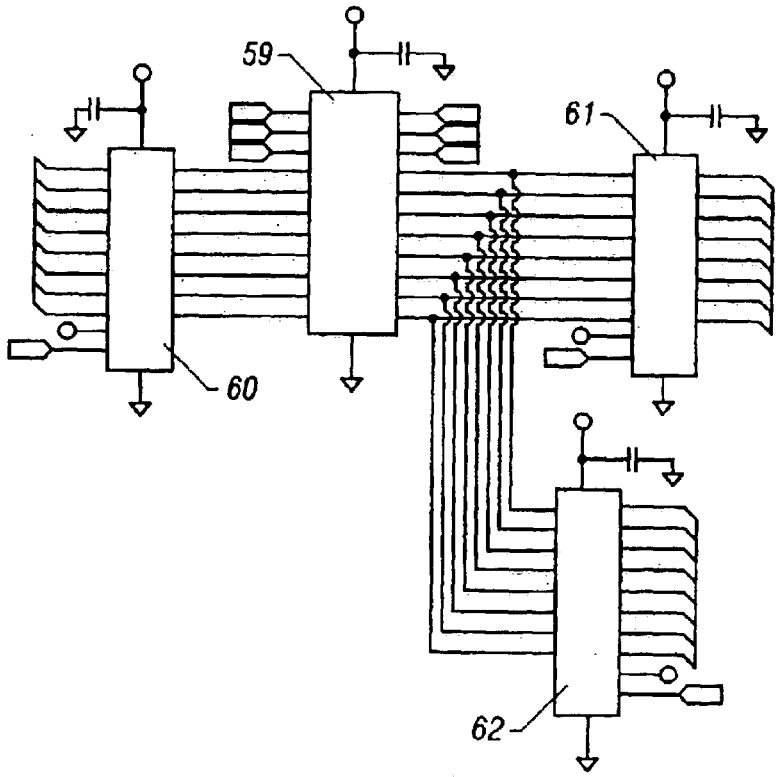
Figure 5:
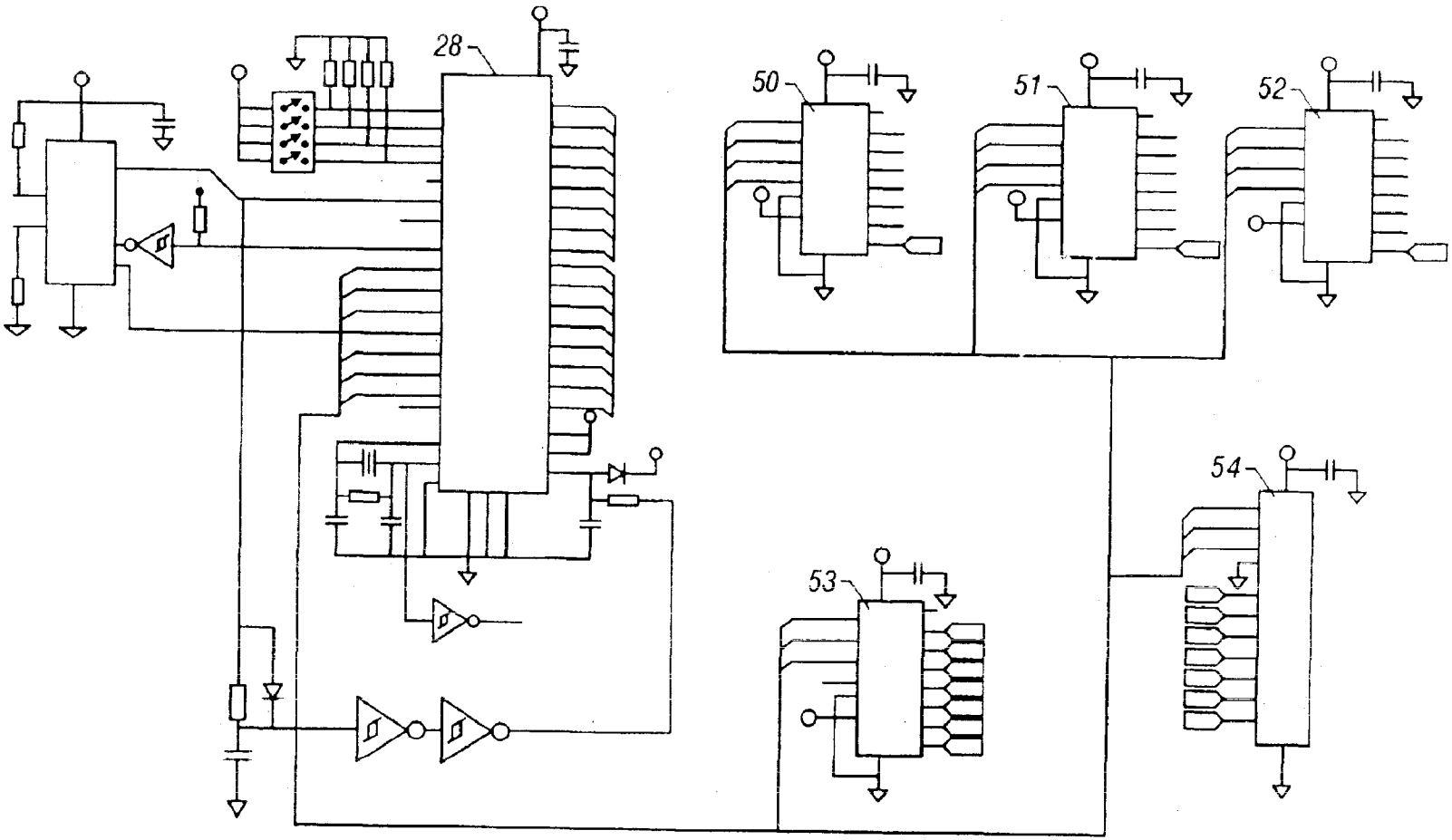
Figure 6:
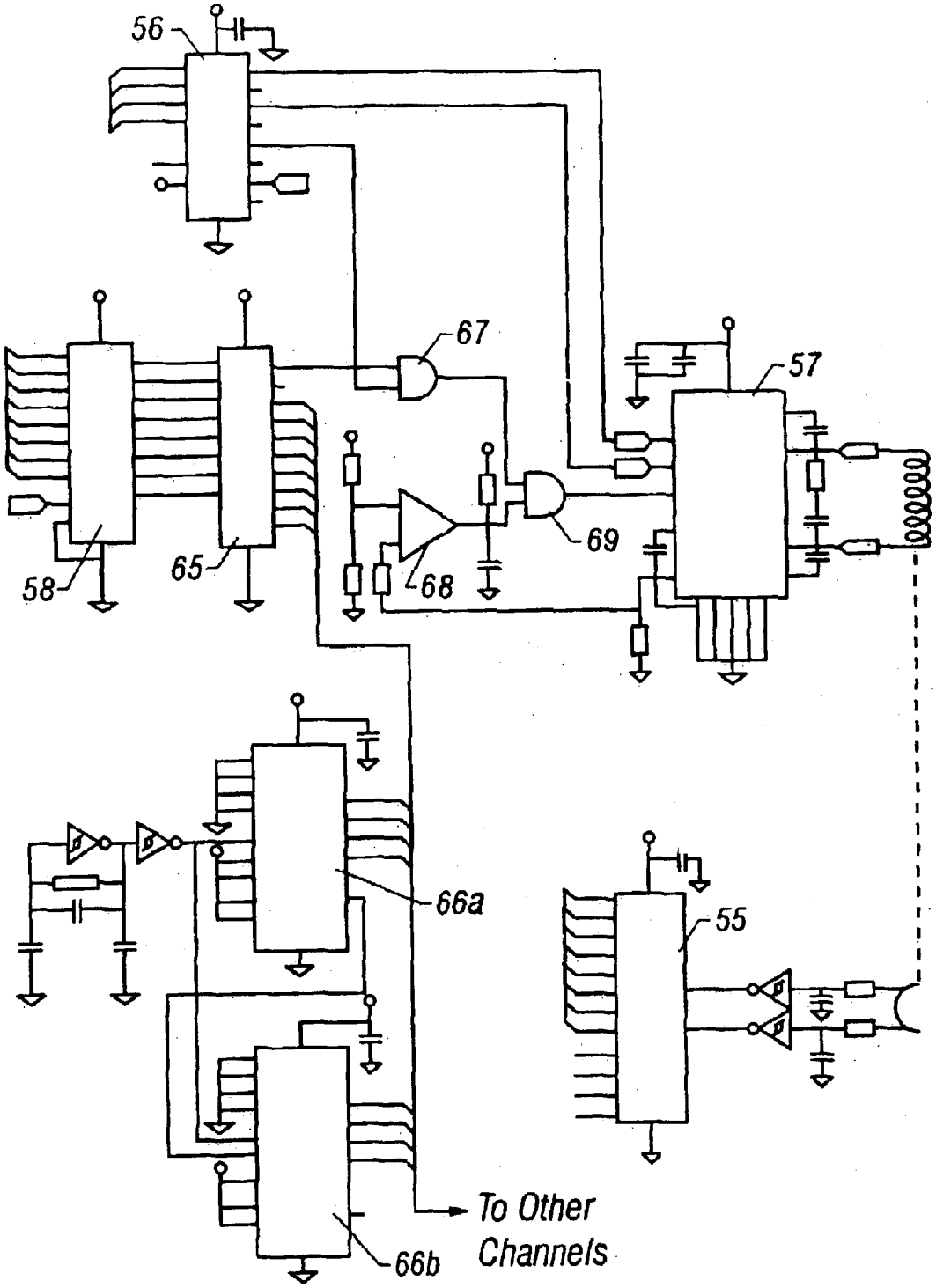

Turning now to FIGS. 5 to 7, the circuitry for controlling the individual dc servo-motors inside the lamp is more complex as each co-processor has to deal with up to six servo-motors. As shown in FIG. 5, the co-processor 28 controls a number of data routers 50 to 54 which determine which channel is being controlled at any given time. The router 50 co-operates with six HCTL-2016 counters 55 which count the quadrature pulse outputs of the respective encoders, to determine which of the counters should supply its count-state to the co-processor 28. Router 51 controls individual resetting of the counters 55. Router 52 co-operates with a 74HC175 ic 56 (one for each channel) to determine which L6202 ic motor controller 57 is enabled and also routes "RIGHT" and "LEFT" signals from the co-processor to the circuits 57. Router 53 controls routing of position error data calculated by the co-processor 28 for each channel to latches 58 (one for each channel) at the input of pulse width modulator circuits for controlling the motor controllers 57. This error data is actually passed to the latch 58 in an inverted form, so that the larger the error, the smaller the value passed is. Router 54 routes various digital sensor signals to a sensor input of the co-processor, Such sensors are utilized by some of the channels to indicate when the moving part in question is in a datum position. This is required for the gobo wheels, the colour wheels and the shutter, but not for the iris diaphragms or lenses which can be moved to end stop positions. During datum set-up the sensors (optical sensors sensing a hole or flag or Hall effect sensors) are detected and the HCTL counters are reset.

As co-processor 28 has only 256 bytes of internal memory, extra memory is required for each channel to store program variables. The RAM selection control circuit is shown in FIG. 7. The memory ic 59 (an HM6116LP ic) has 11 address lines of which eight are connected to the co-processor write bus via a latch circuit 60 and the remaining three or which are connected to spoare outputs of three of the ics 56. Spare outputs of the selectors 50, 51, 52 are connected to control terminals of the memory ic and a spare output of the selector 53 is connected to an output enable terminal of the latch circuit 59. Thus a particular address in the memory ic can be selected by the co-processor by first setting the ics 56 and the selectors 50, 51, 52 to appropriate states and then outputting the lower bytes of the address to latch 60 whilst output from latch 60 is enabled. Two further eight bit latches 61 and 62 provide temporary storage for data to be written to and data just read from the memory ic 59. When neither reads nor writes are required the memory data bus is tri-stated. Bus contention is thus avoided.

Circuit 57 actually controls the motor current, but it in turn is controlled by a pulse width modulator circuit, comprising the latch 58 and a digital comparator 65 which compares the contents of latch 58 with the count-state of an 8-bit continuously running counter 66*a*, 66*b* serving all channels. The comparator output goes high when the count-state exceeds the latch contents, so that if the latch content is low the comparator output is high for a high proportion of each cycle of the counter 66*a*, 66*b*. The output of the comparator 65 is ANDed with an enable output from ic 56 by a gate 67 and then with the output of an overcurrent detector circuit 68 by another gate 69.

When a new target value for one of the parameters controlled by co-processor 58 arrives in the receive buffer, and it is associated with execution duration data (this may apply to lens movements, colour changer movements, gobo movements and iris diaphragm movements, but not shutter movements) the cpu 21 handles time slicing as in the pan and tilt operations. Since several channels are controlled by each co-processor, however, no interpolation by the co-processor is used. Instead each channel has its error checked and a new value written (if necessary) to latch 58 every 12 mS In the case of the shutter, the message received by the lamp merely includes a shutter open or shutter closed command. When the required shutter status changes, the main cpu merely increases the target shutter angle by 45 degrees (in the case of a four bladed shutter) and passes the new value to the co-processor.

This arrangement enables the shutters of some or all of the lamps to be operated in synchronism. Moreover, the console cpu 14, can operate to update the shutter open/closed instructions at regular intervals to obtain a stroboscopic effect, synchronised for all the lights.

What is claimed is:

1. A method, comprising:

receiving, in a stage lighting lamp which produces light to be transmitted to a target, a value of a parameter from the group of parameters consisting of a movement of an optical element, a movement of a color changer, a movement of a light shaping device, or a movement of an iris diaphragm, which value indicates an amount of movement for the parameter;

dividing said amount of movement into an incremental amount of movement, which will each be carried out in a specified time; and outputting movement signals at each of a plurality of specified times corresponding to maid amounts of movement determined in said dividing.

2. A method as in claim 1, wherein each of said incremental amounts of movement corresponds to the same amount of movement.

3. A method as in claim 1, wherein said dividing and outputting is controlled by a main processor.

4. A method as in claim 1, wherein said parameter comprises a parameter for multiple lamps, and further comprising outputting movement signals which controls each of said multiple lamps in a synchronized way.

5. A method as in claim 1, wherein at least one of said incremental amounts of movement is different than another of maid incremental amount of movement.

6. A method as in claim 5, wherein said amount of movement causes said movement to occur according to a sinusoidal profile.

7. A method am in claim 1, wherein said dividing comprises determining a specified period at which said incremental amount of movement will be updated, determining an incremental amount of movement that is necessary in each specified period, and updating said incremental amount of movement for said each specified period.

8. A method as in claim 7, wherein said specified period is milliseconds.

9. A method as in claim 7, wherein said dividing further comprises maintaining a travel variable representing a total amount of movement, incrementing said travel variable by said amount, and terminating said movement when said travel variable reaches a specified amount.

10. An apparatus comprising:

a lighting unit, which produces an output light beam, and is remotely controllable from a remote console;

a processor, associated with said lighting unit, and operating to receive a control for movement of a lighting control parameter, which is a parameter from the group of parameters consisting of a movement of an optical element, a movement of a color changer, a movement of a light shaping device, or a movement of a diaphragm, and to divide said control into a divided control unit representing an amount of movement for each of said parameters which will occur at each of a plurality of times.

11. An apparatus as in claim 10, wherein said movement of an optical element is a lens movement command.

12. An apparatus as in claim 10, wherein each of said divided control units represents a same amount of movement in each of a plurality of same intervals of time.

13. An apparatus as in claim 10, wherein said processor receives said control and produces a plurality of outputs which control a plurality of units to carry out said movement in a synchronized way.

14. An apparatus as in claim 10, further comprising a controller, producing a plurality of outputs for a plurality of different units representing synchronized control of said different units, each unit including a processor, which controls according to at least one of said plurality of outputs.

15. An apparatus as in claim 10, wherein at least one of said divided control units represents a different amount of movement than for another of said divided control units.

16. An apparatus as in claim 15, wherein said amounts of movement causes said movement to occur according to a sinusoidal profile.

17. An apparatus as in claim 10, wherein said processor divides the movement into a plurality of update periods, each update period being multiple milliseconds, and produces output signals at each of said update periods which cause a controlled unit to move.

18. An apparatus as in claim 17, wherein said processor maintains a travel parameter, which represents a total amount of travel which has occurred so far.

19. A lighting control method, comprising:

receiving a control which commands movement of a parameter associated with projection of light, determining a time over which said control should be carried out and dividing said control into a plurality of divided units, each of said units representing an amount of movement which should be carried out in a specified divided time, and outputting signals at each of said specified divided times commanding movement at each of said specified divided times.

20. A method as in claim 19, further comprising maintaining a variable which indicates a total amount of movement at a current time.

21. A method as in claim 19, wherein each of said divided units represents a same amount of movement.

22. A method as in claim 19, wherein at least one of said divided units represents a different amount of movement than another of said divided units.

23. A method as in claim 19, wherein said parameter is a parameter commanding movement of a light shape alteration.

24. A method as in claim 19, wherein said parameter is a parameter commanding changing of a color of light which is projected.

25. A method as in claim 19, wherein said parameter is a parameter commanding changing of a size of a diaphragm.

26. A method as in claim 19, wherein said parameter is a parameter which changes of focusing of light by a lens.

27. A method as in claim 19, wherein said output signals are output to a plurality of different lights and are substantially synchronized with one another.

28. A method as in claim 19, wherein each of said specific divided times occur multiple milliseconds apart.

29. A method as in claim 19, wherein said parameter is a parameter that changes an amount of movement by said light.

30. A system, comprising:

a processor that receives a control that commands movement of a parameter associated with projection of light, and a control that indicates a time for said movement, said processor operating to produce a plurality of divided movement amounts, each of said movement amounts representing a movement which should be carried out at a specific divided time; and an output signal terminal, which provides an output signal that controls said movement at said divided times.

31. A system as in claim 30, wherein said processor produces each of said divided units which represents the same amount of movement.

32. A System as in claim 30, wherein said processor produces at least one of said divided units representing a different amount of movement than another of said divided units.

33. A system as in claim 30, wherein said control represents movement of a light shape alteration.

34. A system as in claim 30, wherein said control represents movement of a gobo.

35. A system am in claim 30, wherein said parameter represents movement of a color changing device.

36. A system as in claim 30 wherein said parameter represents changing a size of a diaphragm.

37. A system as in claim 30, wherein said parameter represents movement of a lens.

* * * * *